US007559550B2

(12) United States Patent
Nam

(10) Patent No.: US 7,559,550 B2
(45) Date of Patent: Jul. 14, 2009

(54) PAPER-DISCHARGING APPARATUS USED WITH AN IMAGE-FORMING DEVICE

(75) Inventor: Dong-soo Nam, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 119 days.

(21) Appl. No.: 10/684,417

(22) Filed: Oct. 15, 2003

(65) Prior Publication Data

US 2005/0098943 A1 May 12, 2005

(30) Foreign Application Priority Data

Jan. 4, 2003 (KR) ..... 10-2003-0000441

(51) Int. Cl.
*B65H 5/02* (2006.01)

(52) U.S. Cl. ..... 271/274; 271/273; 271/314

(58) Field of Classification Search ..... 271/314, 271/274; 347/104

See application file for complete search history.

(56) References Cited

U.S. PATENT DOCUMENTS

| | | | | | |
|---|---|---|---|---|---|
| 4,195,832 | A | * | 4/1980 | Krumrey | 271/274 |
| 4,426,785 | A | * | 1/1984 | Loftus et al. | 33/501.04 |
| 4,611,939 | A | * | 9/1986 | Fujiwara | 400/637 |
| 5,265,869 | A | * | 11/1993 | Morita | 271/274 |
| 5,409,209 | A | * | 4/1995 | Nakamura et al. | 271/271 |
| 5,914,790 | A | * | 6/1999 | Yanagisawa | 358/471 |
| 5,940,671 | A | * | 8/1999 | Kim | 399/318 |
| 6,672,587 | B1 | * | 1/2004 | Mohringer et al. | 271/259 |
| 2002/0057302 | A1 | * | 5/2002 | Shimomura et al. | 347/8 |
| 2002/0130463 | A1 | * | 9/2002 | Michel | 271/274 |

FOREIGN PATENT DOCUMENTS

| | | | |
|---|---|---|---|
| JP | 1-150651 | * | 6/1989 |
| JP | 3-293242 | * | 12/1991 |
| JP | 4-72246 | * | 3/1992 |
| JP | 5-43082 | * | 2/1993 |
| JP | 2001-75377 | * | 3/2001 |

OTHER PUBLICATIONS

Chinese Office Action issued on Sep. 9, 2005, for Chinese Patent Application No. 200310118729.0.

* cited by examiner

*Primary Examiner*—Patrick H Mackey
*Assistant Examiner*—Thomas A Morrison
(74) *Attorney, Agent, or Firm*—Stanzione & Kim LLP

(57) ABSTRACT

A paper-discharging apparatus used with an image-forming device provided with one or more paper-discharging rollers and one or more idle rollers includes a supporting plate installed in the paper-discharging port side of the body of the image-forming device, a supporting bracket rotatably supporting the one or more idle rollers, and a spacing adjustment unit allowing a spacing distance between the supporting bracket and the supporting plate to be variable in response to the shape deformation of the supporting plate. The spacing adjustment unit is provided with an elastic member to restrain a magnitude of a contact pressure generated between the paper-discharging roller and the idler roller from being changed even if a shape of the supporting plate is deformed.

7 Claims, 6 Drawing Sheets

PAPER-DISCHARGING APPARATUS USED WITH AN IMAGE-FORMING DEVICE

CROSS-REFERENCE TO RELATED APPLICATIONS

This application claims the benefit of Korean Patent Application No. 2003-441 filed with the Korea Industrial Property Office on Jan. 4, 2003, the disclosure of which is incorporated herein by reference.

BACKGROUND OF THE INVENTION

1. Field of the Invention

The present invention relates to an image-forming device, and in particular, to a paper-discharging apparatus discharging an image-printed paper to the outside of -a body of an image-forming device.

2. Description of the Related Art

FIG. 1 illustrates an inside of a conventional image-forming device 100, such as an ink-jet printer by way of an example, among various types of image-forming devices, such as an electrophotographic type printer, a copying machine, an ink-jet printer, etc. Referring to FIG. 1, the conventional image-forming device 100 comprises a paper-feeding apparatus 120 feeding a paper, a paper transfer path 130 defined in the inside of a body 110 of the image-forming device to connect the paper-feeding apparatus 120 and a paper-discharging port (not shown), an ink cartridge 140, and a paper-discharging apparatus 150 discharging a printed paper printed by the ink cartridge 140. Reference numeral 145 denotes a carriage accommodating the ink cartridge, in which a carriage is mounted within the body 110 of the image-forming device in such a way that the carriage is transversely movable in an arrowed direction a of FIG. 1.

FIG. 2 illustrates the paper-discharging apparatus 150 extracted from the above-mentioned image-forming device 100 of FIG. 1. Referring to FIGS. 1 and 2, the conventional paper-discharging apparatus 150 comprises one or more paper-discharging rollers 151, a supporting plate 153, a supporting bracket 155, and one or more idle rollers 157.

The paper-discharging rollers 151 are rotatably installed within the body 110 of the image-forming device 100 to be disposed adjacent to the paper-discharging port formed through a side of the body 110 of the image-forming device 100, and are rotationally driven by receiving power from a rotational driving unit (not shown).

The supporting plate 153 is fixed within the body 110 of the image-forming device 100 to face the discharging rollers 151, while the paper transfer path 130 is located between the supporting plate 153 and the discharging rollers 151.

The supporting bracket 155 is installed on the bottom side of the supporting plate 153 to face the paper discharging rollers 151, and the one or more idle rollers are rotatably mounted on the bottom side of the supporting bracket 155 in such a way that the idle rollers 157 mate with the paper-discharging rollers 151, respectively.

The supporting bracket 155 and the supporting plate 153 are firmly connected with each other without any gap formed therebetween by a number of clamping bosses 155*a* and clamping elements 159.

Meanwhile, the idle rollers 157 are arranged so that circumferential surfaces of the idler rollers 157 come into contact with circumferential surfaces of the paper-discharging rollers 151, respectively. As a result, each idle roller 157 rotates in cooperation with the rotationally driven paper-discharging rollers 151, and when the paper-discharging rollers 151 are rotationally driven, a printing paper is transferred toward the paper-discharging port while passing between the idle rollers 157 and the paper-discharging rollers 151.

Because the idle rollers 157 are rotatably supported on the supporting bracket 155 by one or more rotary shafts 158 each formed of a coil spring, the idle rollers 157 are vertically and elastically movable by an external force within limits of elasticity of the rotary shafts 158. Thereby, the idle rollers 157 and/or the paper-discharging rollers 151 can elastically move to compensate for a change of a contact pressure applied to contact surfaces of the idle rollers 157 and the paper-discharging rollers 151. The change of the contact pressure may be caused when a transfer of the printing paper is abnormally executed or when some components of the paper-discharging apparatus 150 are subjected to shape deformation.

The elastic moving limits of the idle rollers 157 and/or the paper-discharging rollers 151 are restricted within a predetermined range in such a way that the contact pressure between each pair of rollers 151 and 157 required to transfer the printing paper can be maintained over a predetermined level. Due to this, when the shape deformation of the supporting plate 153 or the supporting bracket 155 is beyond the elastic movable limits, the loads produced in response to the shape deformation are exerted on only some of the idle rollers 157. In particular, as shown in FIG. 3, if the shape deformation of the supporting plate 153 exceeds the elastically movable limits, the shape deformation of the supporting plate 153 causes the shape deformation of the supporting bracket 155, thereby resulting in that the idle rollers 157 are disposed to be spaced-apart from the paper-discharging rollers 151 beyond a proper gap required to maintain the contact pressure at a predetermined level or to be excessively compressed with respect to the paper-discharging rollers 151. Due to this shape deformation, a so-called skew phenomenon, in which the printing paper is discharged in a direction having an angle with the paper transfer path 130, is generated, and an image is obliquely printed on the printing paper. In addition, there will be caused a problem that a part of the image printed on the printing paper may be damaged by the idle rollers 157 excessively pressing against the paper-discharging rollers 151 as described above.

SUMMARY OF THE INVENTION

Accordingly, the present invention has been made to solve the above-mentioned and/or other problems occurring in the prior art, and an aspect of the present invention is to provide a paper-discharging apparatus used with an image-forming device having an improved structure to restrain a magnitude of a contact pressure generated between an idler roller and a paper-discharging roller from being changed. The contact pressure may be changed when a shape of a supporting plate of the paper-discharging apparatus is deformed.

In order to achieve the above and/or other aspects of the present invention, there is provided a paper-discharging apparatus used with an image-forming device comprising one or more paper-discharging rollers and one or more idle rollers, which are installed in a paper-discharging port side of a body of the image-forming device to mate with each other; a supporting plate installed in a paper-discharging port side of a body of the image-forming device; a supporting bracket rotatably supporting the one or more idle rollers; and a spacing adjustment unit constantly maintaining a contact pressure between the paper-discharging rollers and the idle rollers.

According to another aspect of the present invention, the spacing adjustment unit can restrain a shape of the supporting bracket from being changed in response to shape deformation of the supporting plate, which in turn controls a magnitude of a contact pressure applied between the paper-discharging rollers and the idle rollers. Accordingly, it is also possible to prevent an image from being obliquely printed on a printing paper and to prevent the printing paper from being discharged in a state that the printed image is damaged.

According to another aspect of the present invention, the spacing adjustment unit preferably comprises an elastic member installed between the supporting plate and the supporting bracket so that opposite ends thereof abut against the supporting bracket and the supporting plate, respectively.

In that event, it is possible that the supporting plate and the supporting bracket are connected to be movable with respect to each other.

In addition, it is possible that the spacing adjustment unit further comprises a guide unit which restrains a transverse movement and a bending movement of the elastic member. The guide unit comprises at least one clamping boss wherein the at least one clamping boss protrudes from one of the supporting plate and the supporting bracket such that the clamping boss is located between the supporting plate and the supporting bracket when the supporting plate and the supporting bracket are assembled.

It is also possible that the elastic member comprises a coil spring installed to wrap around a circumferential surface of the clamping boss.

It is an aspect of the invention that the supporting plate and the supporting bracket are connected with each other by a clamping screw, which is inserted into a hole formed through the other one of the supporting plate and the supporting bracket to correspond to the clamping boss, and that the clamping screw is engaged with the clamping boss.

It is an aspect of the invention that at least one clamping boss is provided between the supporting plate and the supporting bracket and the at least one elastic member is provided to correspond to the respective ones of the at least one clamping boss.

A paper-discharging apparatus to discharge a sheet of paper between a paper-discharging roller and an idle roller which are disposed in a paper-discharging port side of an image-forming device includes a supporting plate formed on the paper-discharging port side, a supporting bracket having opposite ends mounted on the supporting plate and having a middle portion, on which the idle roller is rotatably mounted to contact the paper-discharging roller, formed between the opposite ends, and a spacing adjustment unit disposed between the supporting plate and the middle portion of the supporting bracket to adjust a distance between the supporting plate and the middle portion of the supporting bracket when an external force is exerted on one of the supporting plate and the supporting bracket A paper-discharging apparatus to discharge a sheet of paper between a plurality of paper-discharging rollers and a plurality of idle rollers, which are rotated by corresponding ones of the paper-discharging rollers in an image-forming device, the paper-discharging apparatus including a supporting plate formed on the paper-discharging port side, a supporting bracket having opposite ends mounted on the supporting plate and having a middle portion, on which the idle rollers are rotatably mounted to contact corresponding ones of the paper-discharging rollers, formed between the opposite ends, and a spacing adjustment unit disposed between the supporting plate and the middle portion of the supporting bracket to maintain a contact pressure generated between corresponding ones of the paper-discharging rollers and the idle rollers regardless of an external force exerted on one of the supporting plate and the supporting bracket.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
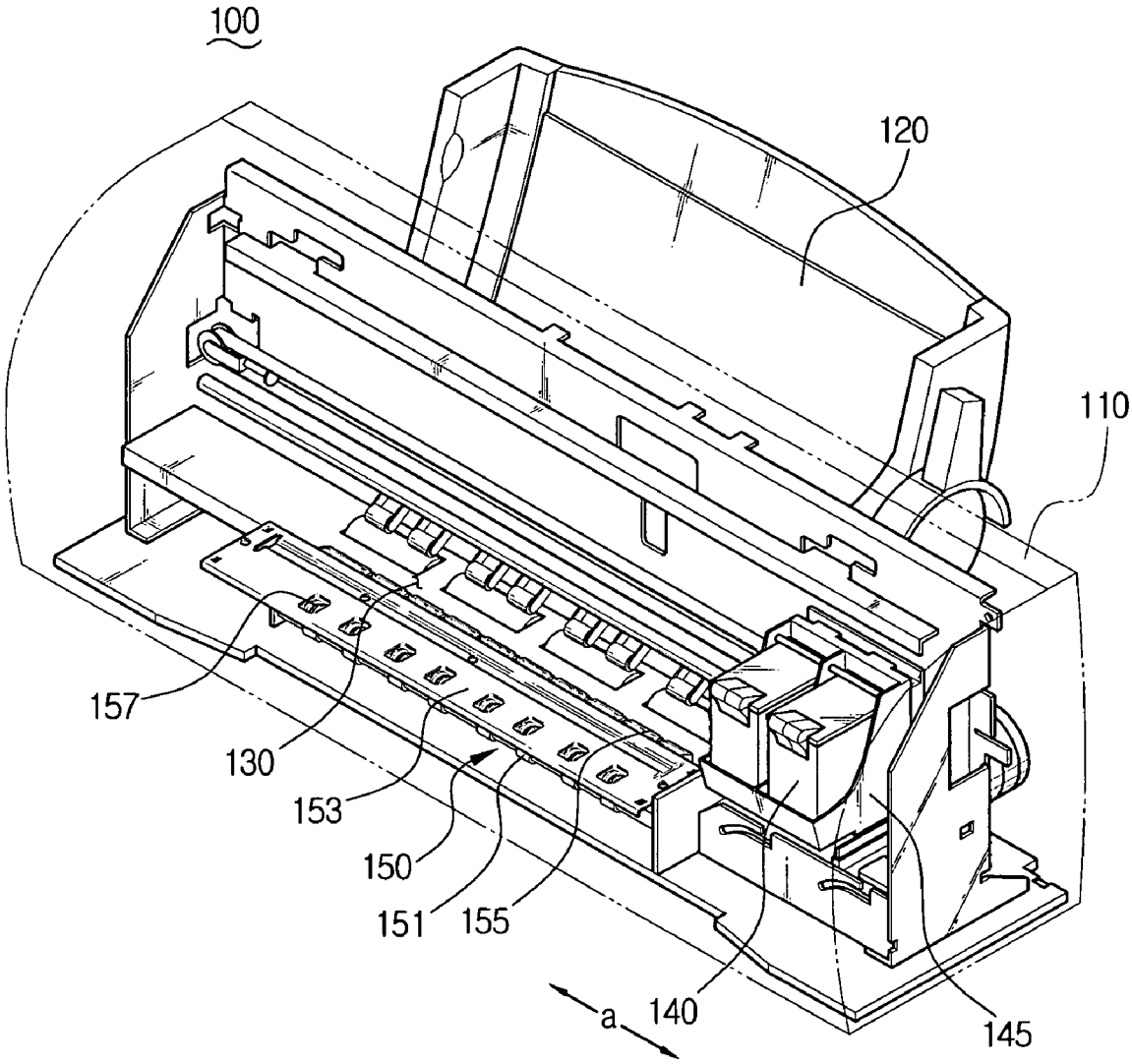
FIG. 1 (PRIOR ART)
FIG. 1 is a perspective view schematically illustrating an inner side of a feeding roller shaft supporter for a conventional image-forming device, such as an ink-jet printer.
Figure 2:
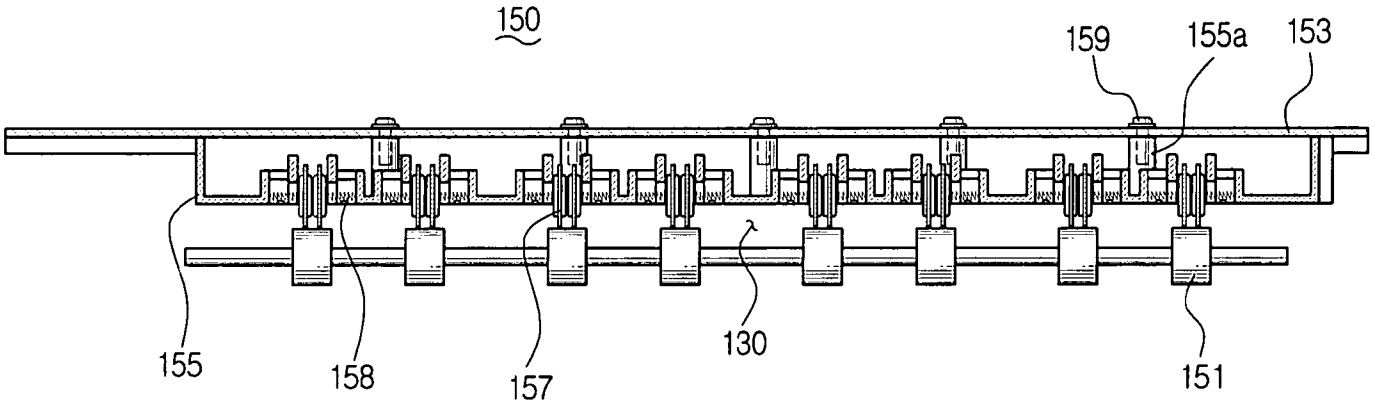
FIG. 2 (PRIOR ART)
FIGS. 2 and 3 are partial cross-sectional views schematically illustrating the paper-discharging apparatus of FIG. 1 before and after a supporting plate and a supporting bracket are deformed.
Figure 3:
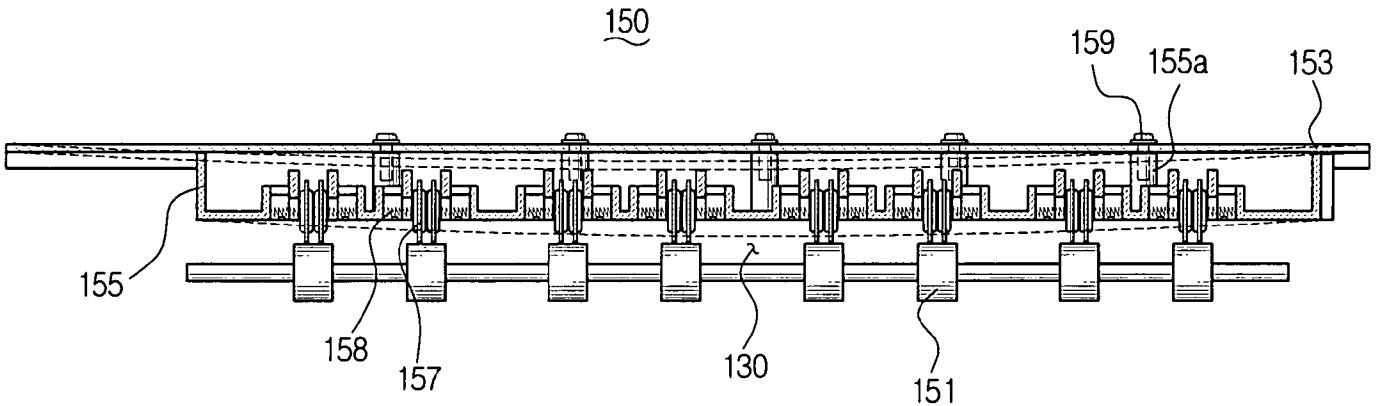
FIG. 3 (PRIOR ART)

Reference will now be made in detail to the embodiments of the present invention, examples of which are illustrated in the accompanying drawings. In the following description of the embodiment of the present invention, like reference numerals will be indicated for the elements having the same structures and functions as a conventional image-forming device of FIGS. 1 to 3, and a detailed description thereof will be omitted.

Figure 4:
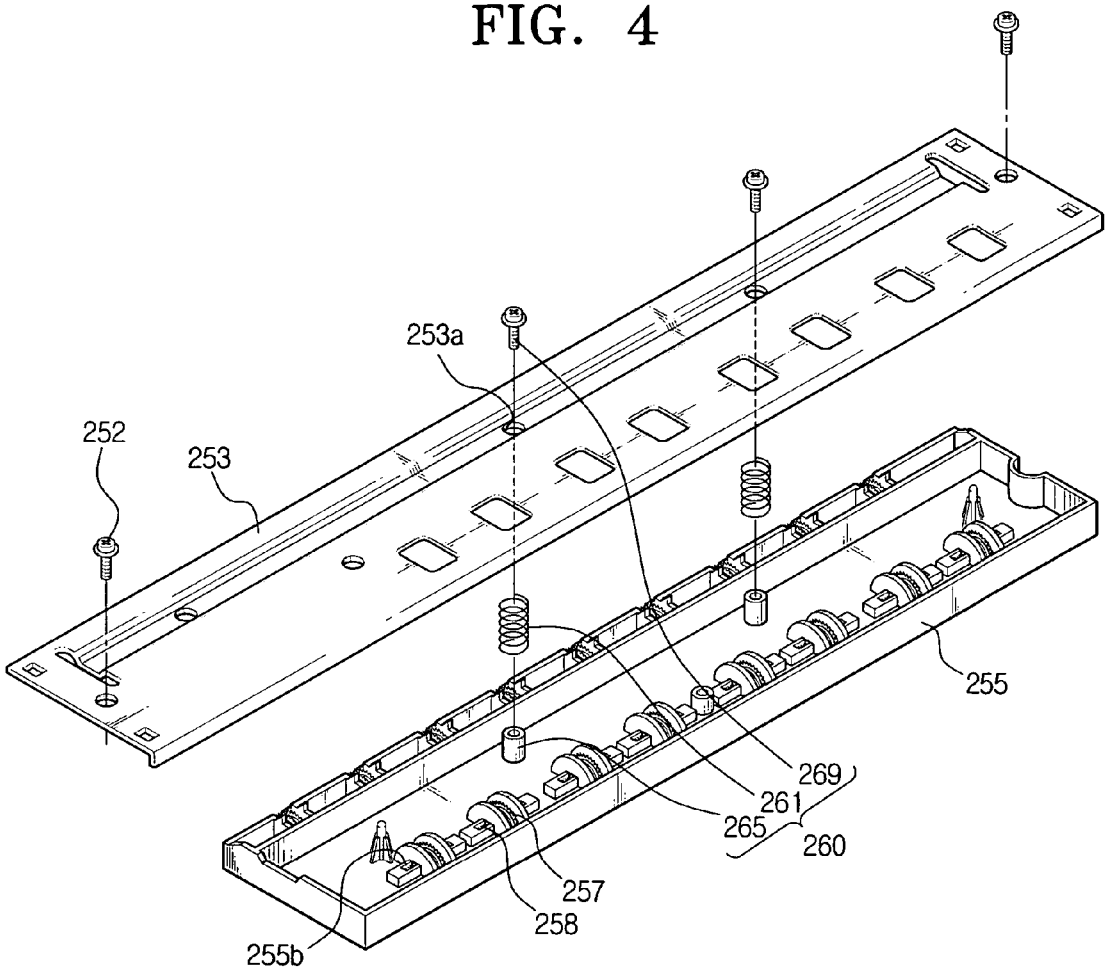
FIG. 4 is an exploded perspective view illustrating an idle roller assembly in a paper-discharging apparatus used with an image-forming device according to an embodiment of the present invention.
Figure 5:
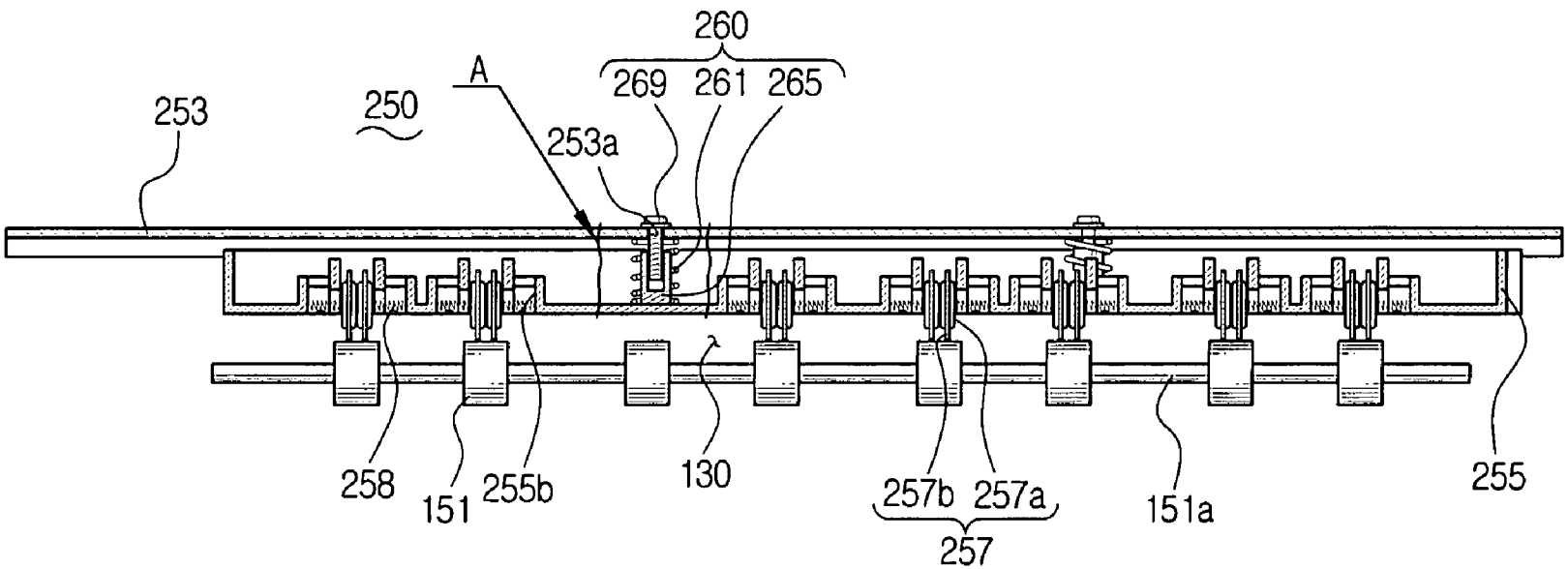
FIG. 5 is a partial cross-sectional view illustrating the paper-discharging apparatus shown in FIG. 4.
Figure 6:
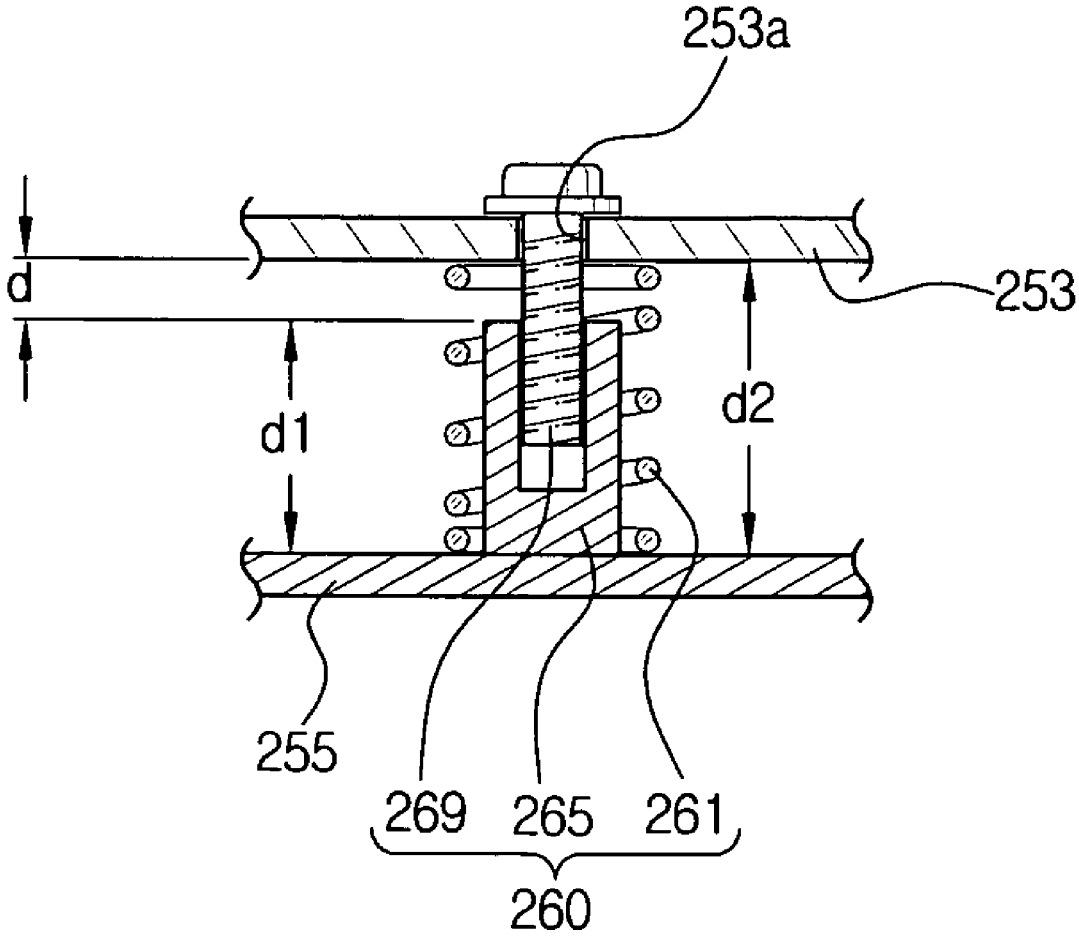
FIG. 6 is an enlarged cross-sectional view of a portion indicated by A shown in FIG. 5.

Referring to FIGS. 4 to 6, a paper-discharging apparatus 250 used with an image-forming device according to the present invention comprises a paper transfer path 130, a supporting plate 253, a supporting bracket 255, one or more idle rollers 257, one or more paper-discharging rollers 151, and one or more spacing adjustment units 260.

The paper transfer path 130 is defined within a body 110 of the image-forming device (see FIG. 1) to connect a paper feeding apparatus 120 and a paper-discharging port (not shown).

The one or more paper-discharging rollers 151 are rotatably installed in the body 110 of the image-forming device adjacent to the paper-discharging port. The paper-discharging rollers 151 of the present embodiment are mounted on a rotation shaft 151*a* rotationally driven by a rotational driving unit (not shown) to feed a printing paper toward the paper-discharging port while the rotation shaft 151*a* is rotationally driven. The paper-discharging rollers 151 may be installed to be elastically movable in a vertical direction. Because it is possible to apply any conventional measure so as to allow for vertical elastic movements of the paper-discharging rollers 151, a detailed description thereof is omitted.

The supporting plate 253 is fixed on the body 110 of the image-forming device adjacent to the paper-discharging port to face the paper-discharging rollers 151, wherein the paper transfer path 130 is defined between the supporting plate 253 and the paper-discharging rollers 151. The opposite ends of the supporting plate 253 are fixed on the body 110 of the image-forming device by a clamping element 252.

The supporting bracket 255 is mounted on a bottom of the supporting plate 253 to face the paper-discharging rollers 151. The supporting bracket 255 and the supporting plate 253 are assembled by using one or more clamping bosses 265 protruding from a top surface of the supporting bracket 255, one or more clamping holes 253*a* formed through the supporting plate 253 to correspond to the clamping bosses 265, and clamping elements 269 inserted through the clamping holes 253*a* and fitted to the clamping bosses 265. In the present embodiment, two clamping bosses 265 are provided on the supporting bracket 255, but they may be provided on the bottom of the supporting plate 253, alternatively, while the clamping holes 253*a* would be formed through the supporting bracket. The clamping elements 269 and the clamping bosses 265 are engaged with each other only until a predetermined spacing distance d (FIG. 6) is maintained between upper ends of the clamping bosses 265 and a bottom surface of the supporting plate 253. Due to -a space formed between the upper ends of the clamping bosses 265 and a bottom surface of the supporting plate 253, the supporting bracket 255 and the supporting plate 253 are connected to be relatively movable toward or away from each other.

Meanwhile, the idle rollers 257 are rotatably supported by rotary shafts 258, respectively, the rotary shafts 258 are individually seated on respective ones of seating recesses 255*b* formed on the bottom surface of the supporting bracket 255, and circumferential surfaces of the idle rollers 257 contact the paper-discharging rollers 151, respectively. The idle rollers 257 are elastically moved toward or away from the paper-discharging rollers 151 by a certain elastic unit. The elastic unit can be implemented in various forms. The elastic unit employed in this embodiment includes the rotary shafts 258 each formed of a coil spring to rotatably support the idle rollers 257 on bottom sides thereof and being subject to elastic shape deformation. Because these idle rollers 257 typically-contact a printed side of the printing paper, they should be formed not to damage an image printed on the printing paper. For this purpose, the paper-discharging apparatus 250 employs star wheels as the idle rollers 257, and each star wheel comprises a wheel body 257*a* rotatably mounted on the bottom of the supporting bracket 255, and an unevenness component 257*b* of a predetermined shape surrounding a circumferential surface of the wheel body 257*a*.

Figure 7:
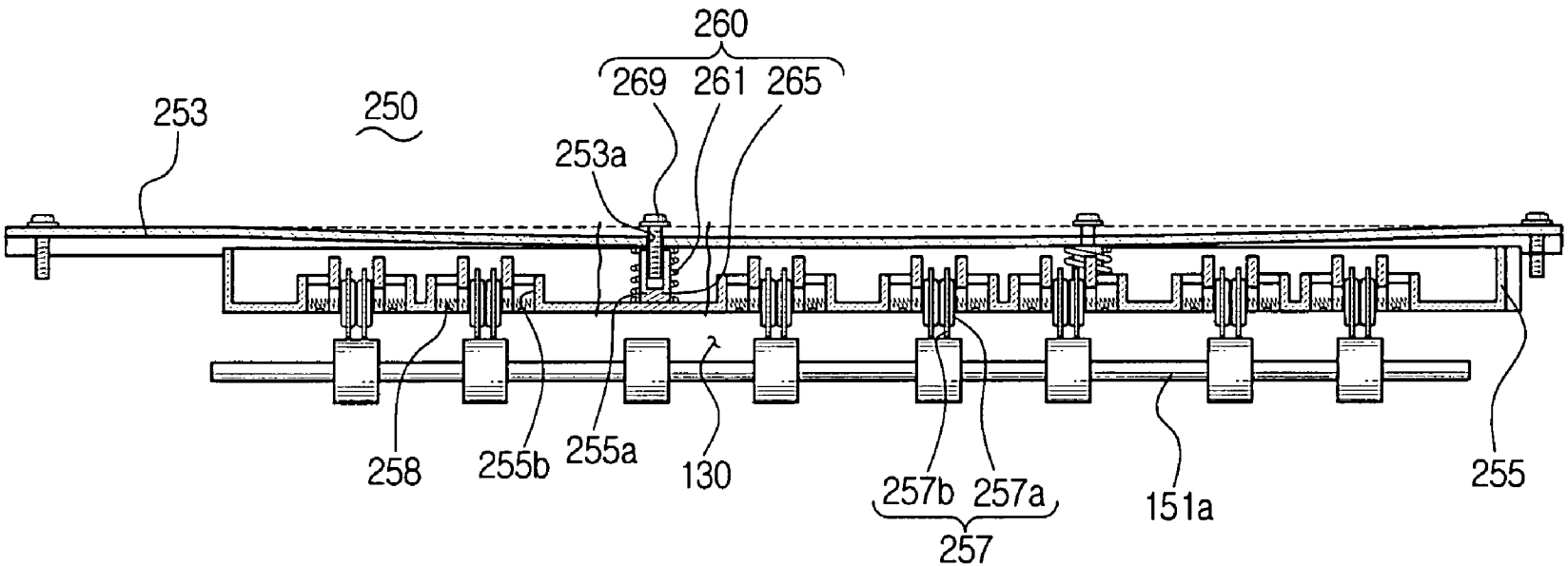
FIG. 7 is a front view illustrating the paper-discharging apparatus according to an embodiment of the present invention in a state where the supporting plate is deformed.

As shown in FIG. 7, the spacing adjustment units 260 are provided to restrain a magnitude of a contact pressure generated between the paper-discharging rollers 151 and the idle rollers 257 from being changed, so that the contact pressure varies due to the shape deformation of the supporting plate when the spacing distance d between the supporting bracket 255 and the supporting plate 253 is changed. Each spacing adjustment unit 260 comprises an elastic member 261, the clamping boss 265, and the clamping element 269. Because the clamping boss 265 and the clamping element 269 have been previously described, a detailed description thereof will be omitted.

In the present embodiment, coil springs are employed as the elastic members 261, which are installed between the supporting plate 253 and the supporting bracket 255, so that opposite ends thereof abut with the top surface of the supporting bracket 255 and the bottom surface of the supporting plate 253, respectively. The elastic member 261 is longer than a length d1 of the clamping bosses 265 (FIG. 6), so that the elastic member 261 is compressed when the supporting plate 253 and the supporting bracket 255 are moved toward each other. In this event, it is possible that the elastic member 261 is formed to be longer than another spacing distance d2 (FIG. 6) between the bottom surface of the supporting plates and the top surface of the supporting bracket 255. The opposite ends of the elastic member 261 abut with the bottom surface of the supporting plate 253 and the top surface of the supporting bracket 255, respectively, so that the supporting bracket 255 and the supporting plate 253 elastically bias away from each other when the clamping elements 269 and the clamping bosses 265 are connected with each other.

According to this structure, the supporting bracket 255 is connected to the supporting plate 253 so that the supporting bracket 255 is elastically movable by the predetermined spacing distance d (FIG. 6) in relation to the supporting plate 253 by a restoration force of the elastic member 261. According to this connection between the supporting bracket 255 and the supporting plate 253, a shape of the elastic member 261 is elastically deformed in response to the shape deformation of the supporting plate 253 instead of a shape deformation of the supporting bracket 255. Therefore, it is possible to restrain the supporting bracket 255 from being deformed in response to the shape deformation of the supporting plate 253. Consequently, it is also possible to restrain the contact pressure generated between the paper-discharging rollers 151 and the idle rollers 257 due to the shape deformation of the supporting bracket 255 caused in response to the shape deformation of the supporting plate 253.

In addition, it is possible to achieve an additional effect that a connected state between the supporting plate 253 and the supporting bracket 255 are maintained by the restoration force of the elastic member 261 even if a small number of clamping elements and clamping bosses 265 are used, as compared to the conventional image-forming device.

Each spacing adjustment unit 260 using the coil springs as the elastic member 261 as described above further comprises a guide unit disposed between the supporting plate 253 and the supporting bracket 255 to restrain the elastic member 261 from being bent at a central portion thereof and to suppress a transverse movement of the elastic member 261, when the elastic member 261 is compressed or expanded. As the guide unit, the present embodiment employs the clamping boss 265 protruding from the top surface of the supporting bracket 255. According to this, because the coil spring 261 is installed to wrap around a circumferential surface of the clamping boss 265, either the bending of the central portion of the elastic member 261 or the transverse movements of the elastic member 261 can be suppressed by the clamping boss 265.

However, the spacing adjustment unit 260 of the present invention is not limited to the previously described embodiment. Although not shown, it is possible to obtain the same effects as the previously described embodiment if the spacing distance is formed between the supporting bracket 255 and the supporting plate 253 when connecting the supporting bracket 255 to the supporting plate 253 and the spacing distance is variable due to elasticity of the supporting plate 253.

In the above, the present invention is described with respect to the paper-discharging apparatus used with an ink-jet printer by way of an example. However, the present invention is equally applicable to any type of image-forming devices discharging an image-printed paper out of the body of the image-forming device through the paper-discharging roller and the idle roller disposed in the paper-discharging apparatus.

According to the present invention as described above, as the spacing distance "d" between the supporting plate 253 and the supporting bracket 255 are rendered to be variable in response to the elastic shape deformation of the supporting plate 253, it is possible to suppress the shape deformation of the supporting bracket 255 caused by the shape deformation of the supporting plate 253. By suppressing the shape deformation of the supporting bracket 255, it is also possible to restrain the magnitude of the contact pressure generated between the idle rollers 257 and the paper-discharging rollers 151 from being changed.

Consequently, it is possible not only to prevent a printing paper from being obliquely discharged but also to prevent the printing image from being damaged by the paper discharging rollers 151 and the idle rollers 257, thereby enhancing an image quality. In addition, even if a small number of the clamping elements 269 are used, the supporting bracket 255 and the supporting plate 253 are engaged with each other by the restoration forces of the elastic members 261, and therefore it is possible to reduce a manufacturing cost of a final product of the image-forming device.

While the preferred embodiments of the present invention has been shown and described with reference to the preferred embodiments thereof, the present invention is not limited to the embodiments. It will be understood that various modifications and changes can be made by those skilled in the art without departing from the spirit and scope of the invention as defined by the appended claims and their equivalents. It shall be considered that such modifications, changes and equivalents thereof are all included within the scope of the present invention.

What is claimed is:

1. A paper-discharging apparatus used with an image-forming device, the paper-discharging apparatus provided with paper-discharging rollers and idle rollers disposed in a paper-discharging port side of the image forming device, in which a sheet of paper is discharged through the paper-discharging rollers and the idle rollers, the paper-discharging apparatus comprising:

a supporting plate coupled at opposite ends thereof to a body of the image-forming device and installed at the paper-discharging port side of the image-forming device;

a supporting bracket coupled at a middle portion thereof to the supporting plate to rotatably support the idle rollers facing the paper-discharging rollers; and a spacing adjustment unit disposed between the idle rollers to constantly maintain a contact pressure between the paper-discharging rollers and the idle rollers, wherein the spacing adjustment unit comprises:

an elastic member provided between the supporting plate and the supporting bracket so that opposite ends thereof abut with the supporting bracket and the supporting plate, respectively; and a guide unit to suppress transverse and bending movements of the elastic member, wherein the guide unit comprises:

at least one clamping boss protruding from one of the supporting plate and the supporting bracket such that the clamping boss is located between the supporting plate and the supporting bracket when the supporting plate and the supporting bracket are assembled; and a hole formed on the other one of the support plate and the support bracket, and the supporting plate and the supporting bracket are connected with each other by a clamping screw inserted into the hole to be engaged with the clamping boss.

2. The paper-discharging apparatus according to claim 1, wherein the supporting plate and the supporting bracket are connected to be movable with respect to each other.

3. The paper-discharging apparatus according to claim 1, wherein the elastic member comprises:

a coil spring installed to wrap around a circumferential surface of the clamping boss.

4. The paper-discharging apparatus according to claim 1, wherein the elastic member is formed longer than a projecting length of the clamping boss by a predetermined length, so that the elastic member is compressed as a spacing distance between the supporting plate and the supporting bracket is reduced when the supporting plate and the supporting bracket are assembled.

5. The paper-discharging apparatus according to claim 4, wherein the spacing adjustment unit further comprises:

another elastic member provided between the supporting plate and the supporting bracket; and another clamping boss provided to correspond to the another elastic member.

6. A paper-discharging apparatus to discharge paper from an image forming device having paper-discharging rollers, comprising:

a supporting plate positioned at a paper-discharging port side of the image forming device and fixedly mounted at opposite ends thereof to a body of the image forming device;

a supporting bracket including idle rollers facing the paper-discharging rollers, the supporting bracket flexibly mounted at a middle portion thereof to the supporting plate to maintain a constant contact pressure between the idle rollers and respective paper-discharging rollers; and a spacing adjustment unit disposed between the idle rollers to constantly maintain a contact pressure between the paper-discharging rollers and the idle rollers, wherein the spacing adjustment unit comprises:

an elastic member provided between the supporting plate and the supporting bracket so that opposite ends thereof abut with the supporting bracket and the supporting plate, respectively; and a guide unit to suppress transverse and bending movements of the elastic member, wherein the guide unit comprises:

at least one clamping boss protruding from one of the supporting plate and the supporting bracket such that the clamping boss is located between the supporting plate and the supporting bracket when the supporting plate and the supporting bracket are assembled; and a hole formed on the other one of the support plate and the support bracket, and the supporting plate and the supporting bracket are connected with each other by a clamping screw inserted into the hole to be engaged with the clamping boss.

7. The paper-discharging apparatus according to claim 6, wherein the supporting plate has a supporting plate axis disposed substantially parallel to at least one of a first center axis of the idle rollers of the supporting bracket and a second center axis of the discharging rollers, and the supporting plate axis of the supporting plate becomes disposed not to be parallel to the at least one of the first center axis and the second center axis according to a force exerted on one of the supporting plate and the supporting bracket while the first center axis and the second center axis are maintained substantially parallel to each other.

* * * * *